US006935140B2

(12) United States Patent
Okamoto

(10) Patent No.: US 6,935,140 B2
(45) Date of Patent: Aug. 30, 2005

(54) METHOD OF KNITTING TUBULAR KNITTED FABRIC

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/503,809

(22) PCT Filed: Feb. 3, 2003

(86) PCT No.: PCT/JP03/01077

§ 371 (c)(1),
(2), (4) Date: Aug. 6, 2004

(87) PCT Pub. No.: WO03/066947

PCT Pub. Date: Aug. 14, 2003

(65) Prior Publication Data

US 2005/0081568 A1 Apr. 21, 2005

(30) Foreign Application Priority Data

Feb. 6, 2002 (JP) ..... 2002-029463

(51) Int. Cl.[7] ..... D04B 7/30
(52) U.S. Cl. ..... 66/69; 66/176
(58) Field of Search ..... 66/60 R, 64, 68–71, 66/169 R, 170, 171, 172 R, 175, 176, 75.1

(56) References Cited

U.S. PATENT DOCUMENTS 5,417,088 A * 5/1995 Nakai ..... 66/76
5,584,197 A * 12/1996 Okuno ..... 66/64
5,956,975 A * 9/1999 Kawashima ..... 66/64
6,070,438 A * 6/2000 Okuno et al. ..... 66/172 R
6,138,482 A * 10/2000 Shima et al. ..... 66/69
6,550,284 B2 * 4/2003 Okamoto ..... 66/69
6,766,667 B2 * 7/2004 Dohtsu et al. ..... 66/69

FOREIGN PATENT DOCUMENTS

JP 3-75656 B2 12/1991
JP 7-78302 B2 8/1995
JP 2514489 B2 4/1996
JP 8-144160 A 6/1996
JP 8-158208 A 6/1996
JP 9-316756 A 12/1997

* cited by examiner

*Primary Examiner*—Danny Worrell
(74) *Attorney, Agent, or Firm*—Rothwell, Figg, Ernst & Manbeck, P.C.

(57) ABSTRACT

In a method of knitting a tubular knitted fabric comprising a first knitted fabric and a second knitted fabric, regions A, B, C in the first knitted fabric of the tubular knitted fabric are folded back at their respective boundaries and then overlapped with a corresponding part of the second knitted fabric and held in that overlapped state. The method comprises (a) the step of forming the region A in the state in which the regions B and C of the first knitted fabric and the second knitted fabric are attached to needles on the second needle bed, (b) the step of forming the region B of the first knitted fabric in the state in which the region A of the first knitted fabric is attached to needles on the first needle bed and also the region C of the first knitted fabric and the second knitted fabric are attached to the needles on the second needle bed, (c) the step of forming the region C of the first knitted fabric in the state in which the regions A and B of the first knitted fabric is attached to the needles on the first needle bed and also the second knitted fabric is attached to the needles on the second needle bed, and (d) the step of forming the second knitted fabric in the state in which the regions A, B, and C of the first knitted fabric are attached to the needles on the first needle bed. This knitting can permit knitting of the tubular knitted fabric of a larger diameter using the needle bed having the common width.

4 Claims, 8 Drawing Sheets

METHOD OF KNITTING TUBULAR KNITTED FABRIC

This application is a 35 USC § 371 National Phase Entry Application from PCT/JP03/01077, filed Feb. 3, 2003, and designating the U.S.

TECHNICAL FIELD

The present invention relates to a method of knitting a tubular knitted fabric, whose first and second knitted fabrics are continuously connected with each other at both ends thereof, on a flat knitting machine comprising at least a pair of front and back needle beds in such a manner that the knitted fabric is folded in three layers in at least a part of regions of the first knitted fabric of the tubular knitted fabric and then overlapped with the second knitted fabric, so as to be knitted in four layers.

BACKGROUND ART

Knitting methods to minimize an after-treatment effort after completion of the knitting have been invented, according to which the knitted fabric is bound off at an end portion thereof in the process of knitting the knitted fabric, using a flat knitting machine comprising front and back needle beds having a number of knitting needles on their upper surfaces and disposed in front and back to be opposite to each other and capable of being racked in the longitudinal direction of the needle beds.

To take one example of these knitting methods, a knitted fabric is knitted in the form of, what is called, an integral garment which is knitted in the way that respective parts of the knitted fabric, such as a front body, a back body, a right sleeve, and a left sleeve, are knitted in accordance to their respective shapes and after completion of this knitting, those parts are joined together to form a knitwear. Also, another example is a method of knitting, what is called, a seamless knitted fabric, such as a sweater whose neckline is formed while the bodies and the sleeves are joined together, in such a manner that the after-treatment effort after completion of the knitting can be completely or substantially eliminated.

When the seamless knitted fabric is knitted in the form of the tubular knitted fabric, whose front and back bodies are continuously connected with each other at both ends thereof, on the flat knitting machine, a diameter of the tubular knitted fabric to be knitted is dependent on the width of the needle beds used for the knitting. Accordingly, the knitting of a tubular knitted fabric of a larger diameter requires wider needle beds of the flat knitting machine used for the knitting.

It is an object of the present invention to provide a method of knitting a tubular knitted fabric, whose first and second knitted fabrics are continuously connected with each other at both ends thereof, on a flat knitting machine comprising at least a pair of front and back needle beds in such a manner that the knitted fabric is folded in three layers in at least a part of regions of the first knitted fabric of the tubular knitted fabric and then overlapped with the second knitted fabric, so as to be knitted in four layers.

DISCLOSURE OF THE INVENTION

In order to solve the problem above, the present invention provides a method of knitting a tubular knitted fabric, whose first knitted fabric and second knitted fabric are continuously connected with each other at both ends thereof, using a flat knitting machine comprising at least a pair of first and second needle beds arranged in front and back, either of or both of which are slidably moved in a transverse direction, wherein three sectioned portions of a front-layer knitted fabric portion, a middle-layer knitted fabric portion and a back-layer knitted fabric portion, into which a part of the first knitted fabric is sectioned in a widthwise direction of the knitted fabric, are folded back in three layers at their respective boundaries so that the front-layer knitted fabric portion, the middle-layer knitted fabric portion and the back-layer knitted fabric portion can be formed sequentially from a front side of the knitted fabric, whereby after completion of the knitting of the knitted fabric, the back-layer knitted fabric portion in that folded region, or both of the back-layer knitted fabric portion and the middle-layer knitted fabric portion can be developed in a widthwise direction of the knitted fabric, the method comprising:

(a) the step of forming the front-layer knitted fabric portion in the state in which the middle-layer knitted fabric portion and the back-layer knitted fabric portion and the second knitted fabric are attached to needles on the second needle bed, (b) the step of forming the middle-layer knitted fabric portion in the state in which the front-layer knitted fabric portion is attached to needles of the first needle bed and also the back-layer knitted fabric portion and the second knitted fabric are attached to the needles on the second needle bed, (c) the step of forming the back-layer knitted fabric portion in the state in which the front-layer knitted fabric portion and the middle-layer knitted fabric portion are attached to the needles on the first needle bed and also the second knitted fabric is attached to the needles on the second needle bed, and (d) the step of forming the second knitted fabric in the state in which the front-layer knitted fabric portion, the middle-layer knitted fabric portion, and the back-layer knitted fabric portion are attached to the needles on the first needle bed.

In the construction of the invention, the knitting is performed so that the front-layer knitted fabric portion, the middle-layer knitted fabric portion, and the back-layer knitted fabric portion and the second knitted fabric can be folded over in four layers in the state in which loops of the front-layer knitted fabric portion, middle-layer knitted fabric portion and back-layer knitted fabric portion and loops of the second knitted fabric are attached to the first needle bed or the second needle bed by transferring the loops of the front-layer knitted fabric portion, middle-layer knitted fabric portion and back-layer knitted fabric portion and loops of the second knitted fabric between the front and back needle beds. This knitting to fold back the knitted fabric can allow the knitting of the tubular knitted fabric having a diameter larger than a width of the needle bed used for the knitting.

It is a characteristic feature of the invention that loops that results in a front stitch on completion of the knitting are formed as a back stitch in the middle-layer knitted fabric portion, and loops that results in a back stitch on completion of the knitting are formed as the front stitch in the middle-layer knitted fabric portion.

It is also a characteristic feature of the invention that the middle-layer knitted fabric portion is formed with the needles on the second needle bed.

It is also a characteristic feature of the invention that a folded-in-three-layer region, which is substantially identical with the folded region formed in the first knitted fabric and is formed into the front-layer knitted fabric portion, the middle-layer knitted fabric portion, and the back-layer knitted fabric portion sequentially from the front side of the knitted fabric, is also formed in the second knitted fabric in a region thereof different from the folded region in the first knitted fabric with respect to a longitudinal direction of the needle bed.

In this construction of the invention, the knitted fabric is knitted to be folded back in three layers in both of the first knitted fabric and the second knitted fabric.

BRIEF DESCRIPTION OF THE DRAWINGS

FIG. 1-*b* is a sectional view of the same taken along line i—i of FIG. 1-*a*.

FIG. 2-*b* is a diagram showing the retained states of the knitted fabric corresponding to the stages P1 to P4 of FIG. 2-*a*, respectively. FIG. 2-*c* is a diagram showing the loop position in the stage P1.

FIG. 7-*b* is a diagram showing the loop position of the tubular knitted fabric 11. FIG. 7-*c* is a view showing a developed state of the tubular knitted fabric 11.

BEST MODE FOR CARRYING OUT THE INVENTION

An example of certain preferred embodiments of the present invention will be described in detail with reference to the accompanying drawings. In the following explanation, a four-bed flat knitting machine comprising a pair of front lower and back lower needle beds and upper needle beds disposed over the pair of lower needle beds, respectively, is used for the knitting. A two-bed flat knitting machine comprising only a pair of front and back needle beds can also be applicable to the knitting method of the invention. When the two-bed flat knitting machine is used for the knitting, the knitting method, which is called the half-gauge knitting, can be used practically. In the half gauge knitting, loops of the front knitted fabric are allocated to odd-numbered needles of the front and back needle beds and loops of the back knitted fabric are allocated to even-numbered needles of the needle beds. Then, when the front knitted fabric is knitted, it is knitted in the state in which the loops of the back knitted fabric are all attached to the needles on the back needle bed, while on the other hand, when the back knitted fabric is knitted, it is knitted in the state in which the loops of the front knitted fabric are all attached to the odd-numbered needles on the front needle bed. The phrase that the front knitted fabric is attached to the front needle bed means that when the knitted fabric other than the front knitted fabric is formed, the loops of the front knitted fabric are all held by the needles of the front needle bed. The phrase that the back knitted fabric is attached to the back needle bed means that when the knitted fabric other than the back knitted fabric is formed, the loops of the back knitted fabric are all held by the needles of the back needle bed. As the half gauge knitting is already disclosed in JP Patent Publication No. Hei 3-75656 as previously filed by the same applicant, any further description thereon is omitted.

First Embodiment

Figure 1:
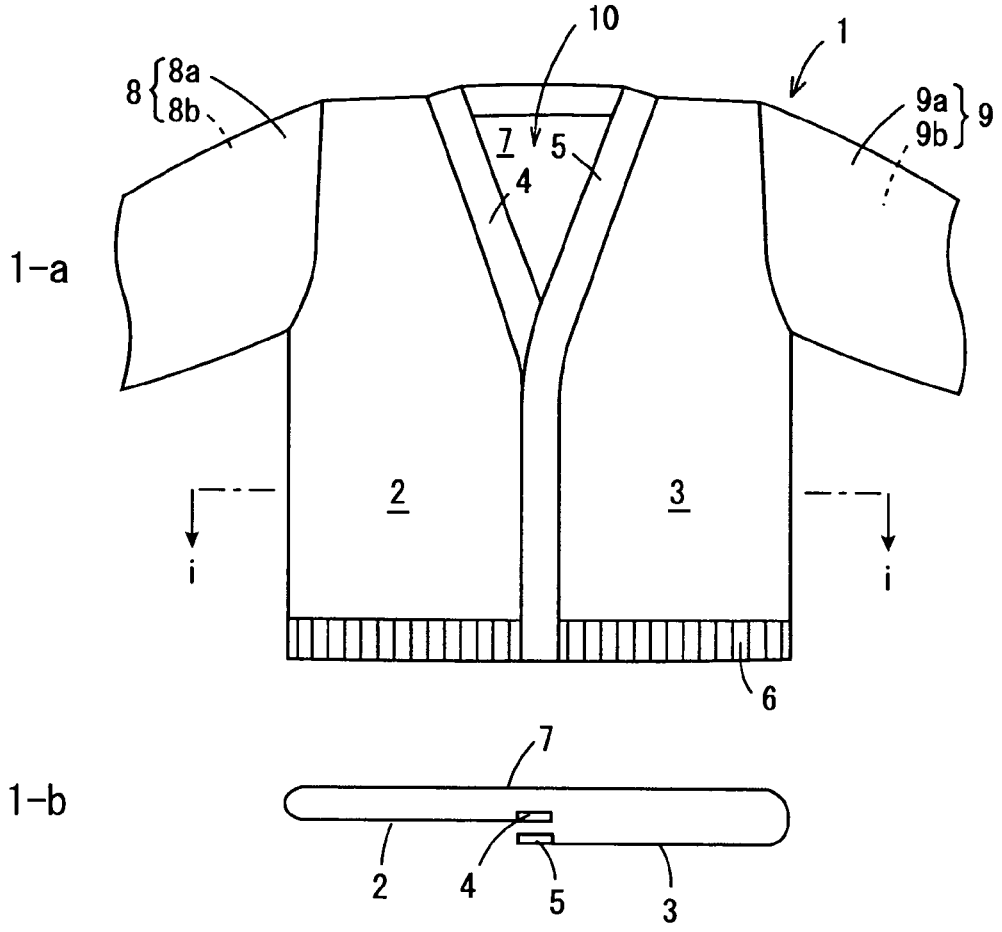
FIG. 1-*a* shows a cardigan knitted in the first embodiment.
Figure 2:
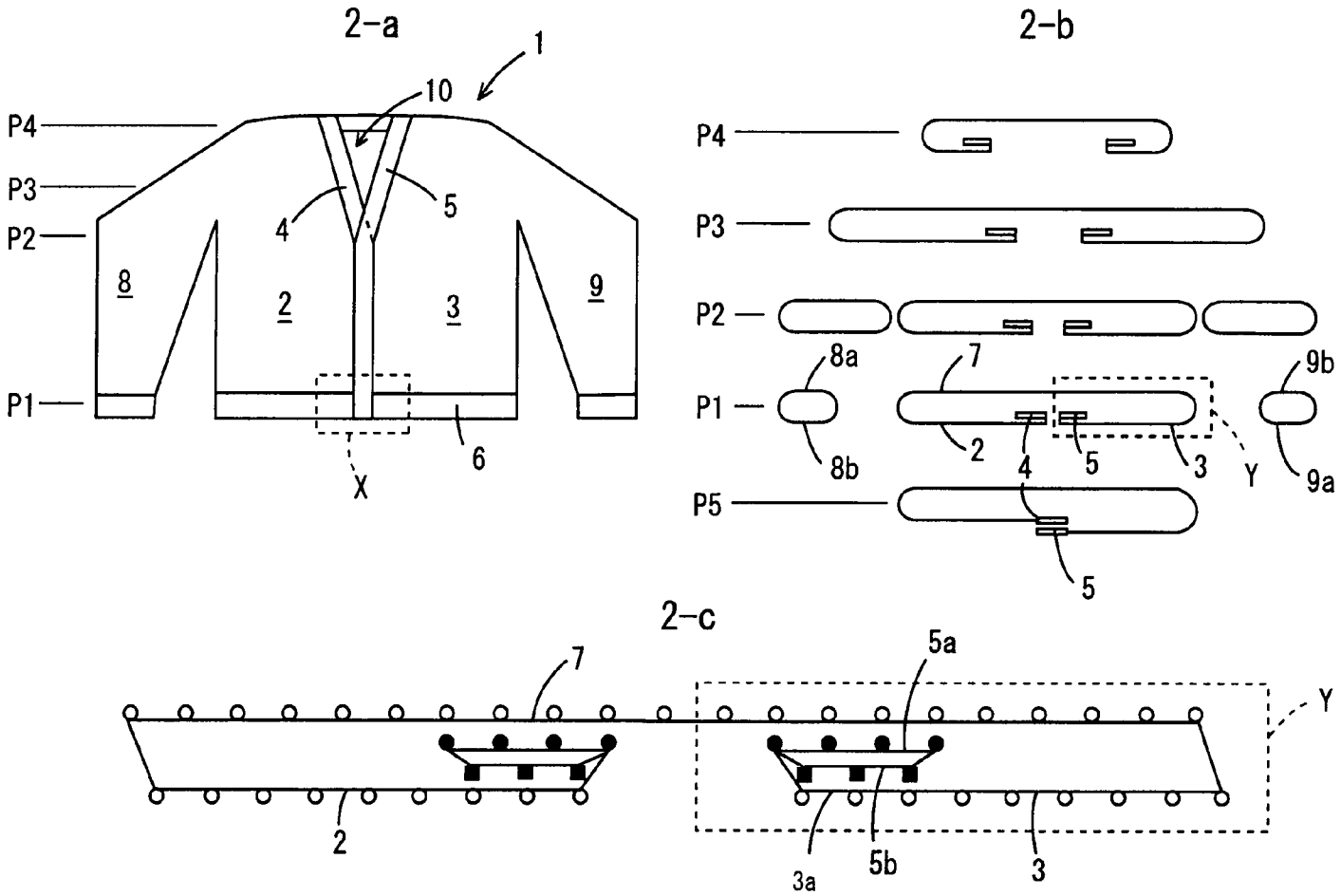
FIG. 2-*a* is a diagram schematically showing the knitting processes of the cardigan 1 by using a flat knitting machine.
Figure 3:
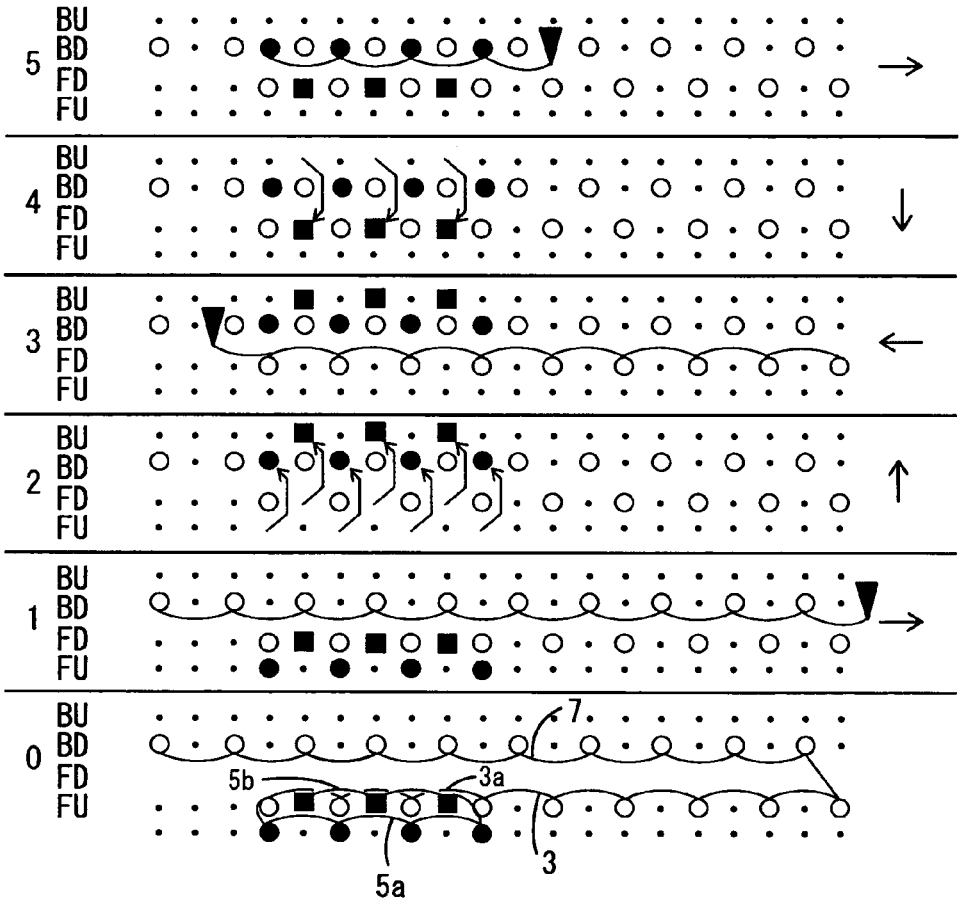
FIG. 3 is a knitting course diagram illustrating the first embodiment.
Figure 4:
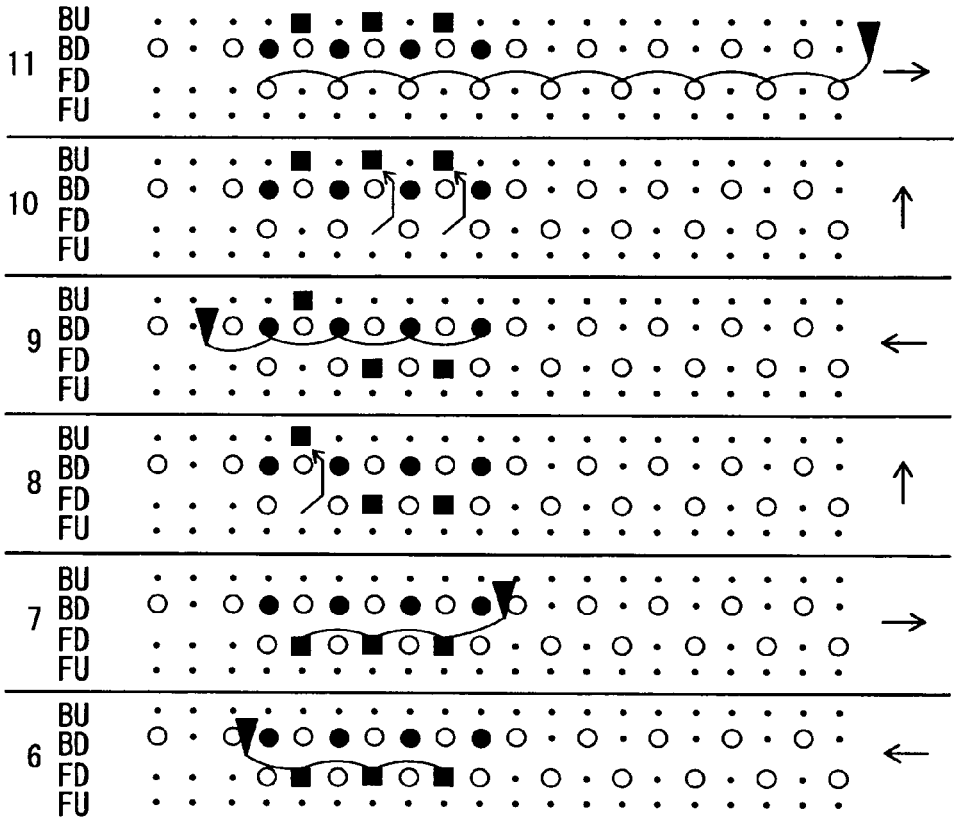
FIG. 4 is a knitting course diagram illustrating the first embodiment.
Figure 5:
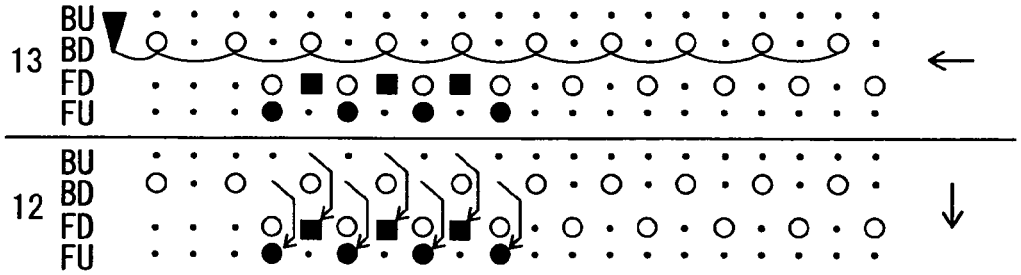
FIG. 5 is a knitting course diagram illustrating the first embodiment.
Figure 6:
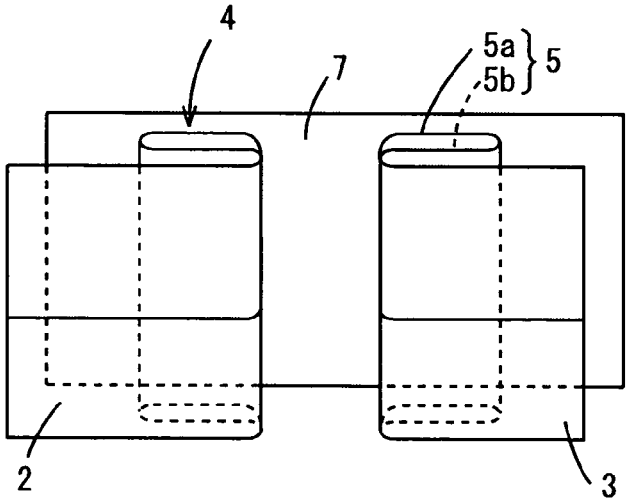
FIG. 6 is a perspective sectional view of the part surrounded by a dotted line X in FIG. 2-*a*.

In the following, the first embodiment will be described with reference to FIGS. 1 to 6. FIG. 1-*a* shows a cardigan 1 knitted in the first embodiment. FIG. 1-*b* is a sectional view of the same taken along line i—i of FIG. 1-*a*. The cardigan 1 is formed so that when wearing, tubular hemmed portions 4, 5 formed along an opening of the right front and left front bodies 2, 3 can be overlapped one above the other. FIG. 2-*a* is a diagram schematically showing the knitting processes of the cardigan 1 by using the flat knitting machine. FIG. 2-*b* is a simplified illustration of the retained states of the knitted fabric corresponding to the stages P1 to P4 of FIG. 2-*a*, respectively. FIG. 2-*c* is a diagram showing the loop position of a body portion in the stage P1. FIGS. 3–5 are knitting course diagrams illustrating the first embodiment. FIG. 6 is a perspective sectional view of the part surrounded by a dotted line X in FIG. 2-*a*. All parts of the cardigan 1, except a rib 6 and the hemmed portions 4, 5 are formed with a plain knitting structure. The rib 6 is formed with a rib knitting structure and the hemmed portions 4, 5 are formed with a tubular knitting structure. In the following, the knitting in the states P1–P4 will be explained.

In the stage P1, the cardigan 1 is formed in such a relation that the hemmed portions 4, 5 overlapped one above the other in wearing and extending along the opening of the front body are folded inward of the right front and left front bodies 2, 3. In a region where the hemmed portions 4, 5 are formed, the knitting is performed in such a manner that the tubular hemmed portions 4, 5 and the front bodies 2, 3 and back body 7 are overlapped in four layers. The body consisting of the front bodies 2, 3 and the back body 7 is knitted from a hem side toward a shoulder and right and left sleeves 8, 9 are knitted from a cuff side toward the shoulder. The front bodies 2, 3 and the back body 7 are knitted in order of the right front body 2-the back body 7-the left front body 3 in a generally C-shape via a single yarn feeder, with the opening as a reversing point of the yarn feeder. The right and left sleeves 8, 9 are knitted in such a manner that front sleeves 8*a*, 9*a* and back sleeves 8*b*, 9*b* are cyclically knitted via the respective yarn feeders used to knit them.

In the stage P2, the bodies 2, 3, 7 and the sleeves 8, 9 are simultaneously knitted up to the armhole, while the knitting to gradually widen a neckline opening 10 is performed. In the stage P3, the joining of the sleeves 8, 9 and the bodies 2, 3, 7 is completed and then the sleeves 8, 9 and the bodies 2, 3, 7 are knitted in the form of a large tubular body in the same knitting as the knitting of the bodies in the stage P1. In the stage P4, the neckline opening 10 is further widened. The stage P5 shows a sectional view of the knitted fabric as completely knitted taken along line i—i of FIG. 1, showing a developed state of the hemmed portions 4, 5 as were knitted to be folded inward of the front bodies 2, 3 in the knitting processes of the bodies. When the hemmed portions 4, 5 folded in are developed, a combined circumferential length of the front bodies including the right front body 2 and the left front body 3 obtained when the hemmed portion 4 of the right front body 2 and the hemmed portion 5 of the left front body 3 are put in the state of being overlapped one above the other comes to be equal to a circumferential length of the back body 7.

In the following, explanation is given with reference to FIGS. 3 to 5. Except that the hemmed portions 4, 5 of the front bodies 2, 3 are knitted in the state of being folded, the rest of the knitted fabric can be knitted by a known knitting method. Accordingly, only the knitting in the bodies 2, 3, 7 are described in the following explanation. Further, since the bodies 2, 3, 7 are knitted with left-right symmetry in the common knitting, only the knitting of the left part of the bodies surrounded by dotted lines Y in FIGS. 2-*b* and 2-*c* is described. In the following explanation, for convenience of explanation, an even fewer number of needles for the knitting than the actual number of needles used for the actual knitting are used.

The numerals at the left side of FIG. 3 showing the knitting course indicate the serial number of the knitting courses. Horizontal arrows indicate the knitting direction and vertical arrows indicate the loop-transference direction. FD designates a lower front needle bed, and BD designates a lower back needle bed. Also, FU designates an upper front needle bed, and FB designates an upper back needle bed. The course 0 in FIG. 3 indicates the loop position of a portion of the cardigan where the hemmed portion 5 is formed. In the course 0, the back body 7 is held by the odd-numbered needles from the left end of the upper back needle bed. The hemmed portion 5 is held in the state of being folded inward of the left front body 3 including a front-layer knitted fabric portion 3*a*. A back-layer knitted fabric portion 5*a* of the hemmed portion 5 that when wearing comes up to the front surface of the knitted fabric is held by even needles on the upper front needle bed. A middle-layer knitted fabric 5*b* of the hemmed portion 5 that when wearing comes to hide inside is held by odd needles on the lower front needle bed. All loops of the knitted fabric except those in the hemmed portions are depicted by white circles. The loops of the knitted fabric are held by the even needles of the lower front needle bed.

In the course 1, a yarn is fed rightward to the odd needles of the lower back needle bed to knit the back body 7 in the state in which the loops of the left front body 3 and the hemmed portion 5 are all attached to the front needle bed (upper front needle bed or lower front needle bed). In the course 2, the back-layer knitted fabric portion 5*a* is transferred to empty needles of the upper back needle bed and the loops of the middle-layer knitted fabric portion 5*b* are transferred to the lower back needle bed, so that before the knitting of the left front body 3, loops of the hemmed portion 5 are attached to the back needle bed not to cause an obstruction to the knitting of the left front body 3. In the course 3, loops of the next course are formed in the left front body 3 and the front-layer knitted fabric 3*a* which are held by the needles on the lower front needle bed in the state in which the back-layer knitted fabric portion 5*a*, the middle-layer knitted fabric portion 5*b* and the back body 7 are attached to the back needle bed (the upper back needle bed or the lower back needle bed). In the course 4, before the forming of the back-layer knitted fabric portion 5*a*, the loops of the middle-layer knitted fabric portion 5*b* held by the needles of the upper back needle bed are transferred onto the lower front needle bed to let the middle-layer knitted fabric portion 5*b* be attached to the front needle bed. In the course 5, the back-layer knitted fabric portion 5*a* is knitted rightwards in the state in which the front-layer knitted fabric portion 3*a* and the middle-layer knitted fabric portion 5*b* are attached to the front needle bed and the back body 7 is attached to the back needle bed. In the next course 6, the middle-layer knitted fabric portion 5*b* is knitted to form the tubular hemmed portion 5. As a result of this, the front-layer knitted fabric portion 3*a*, the middle-layer knitted fabric portion 5*b*, the back-layer knitted fabric portion 5*a* and the back body 7 are folded over in four layers. Then, the knitting in C-shape is reversed in knitting direction, and in the course 7, the middle-layer knitted fabric portion 5*b* is knitted from left to right. In the course 8, the loops at the boundary between the middle-layer knitted fabric portion 5*b* and the back-layer knitted fabric portion 5*c* are transferred to the upper back needle bed. In the course 9, loops of the next course are formed in the back-layer knitted fabric portion 5*a* on the lower back needle bed. As a result of this knitting, the loops at the boundary between the middle-layer knitted fabric portion 5*b* and the outer-layer knitted fabric portion 5*a* are connected with the front-layer knitted fabric portion 5*a*, so that the back-layer knitted fabric portion 5*a* and the middle-layer knitted fabric portion 5*b* are formed in a tubular form. In the course 10, before the knitting of the front-layer knitted fabric portion 3*a* the loops of the middle-layer knitted fabric portion 5*b* are transferred to the upper back needle bed. In the course 11, the front-layer knitted fabric portion 3*a* and the left front body 3 are knitted rightwards in the state in which the middle-layer knitted fabric portion 5*b*, the back-layer knitted fabric portion 5*c* and the back body 7 are attached onto the back needle bed. In the course 12, before the knitting of the back body 7, the loops of the back-layer knitted fabric portion 5*a* and the middle-layer knitted fabric portion 5*b* are transferred to the upper front needle bed and the lower front needle bed, respectively. In the course 13, the back body 7 is knitted leftwards in the state in which the front-layer knitted fabric portion 5*a*, the middle-layer knitted fabric portion 5*b* and the back-layer knitted fabric portion 5*c* are attached to the front needle bed. Subsequently, the same knitting is taken for the right side of the body, then returning to the knitting of from the course 1 of FIG. 3 to the course 13 of FIG. 5. This knitting is repeatedly performed and thereby the bodies of the cardigan 1 of FIG. 1 are knitted.

In the cardigan 1 knitted in accordance with the knitting mentioned above, the hemmed portion 4 of the right front body 2 and the hemmed portion 5 of the left front body 3 are each knitted to be folded inwardly so as to have four layers in all as combined with the back body 7, as shown in FIG. 6. After completion of the knitting, the hemmed portions 4, 5 are developed, so that the hemmed portions 4, 5 of the right and left front bodies 2, 3 are overlapped one above the other, as shown in FIG. 1-*b*. In the knitting method of this embodiment, three regions of the knitted fabric extending continuously in a widthwise direction of the knitted fabric are knitted to be folded over in three layers on completion of the knitting, as mentioned above. This can produce the same effect as the effect resulting from the widening of the knitting width. Also, the hemmed portions 4, 5 are formed in the state of being folded back inward of the front bodies 2, 3, respectively. This can produce the result that when the hemmed portion 4 of the right front body 2 and the hemmed portion 5 of the left front body 3 are overlapped one above the other, a combined circumferential length of the front bodies 2, 3 comes to be equal to a circumferential length of the back body 7.

Second Embodiment

Figure 7:
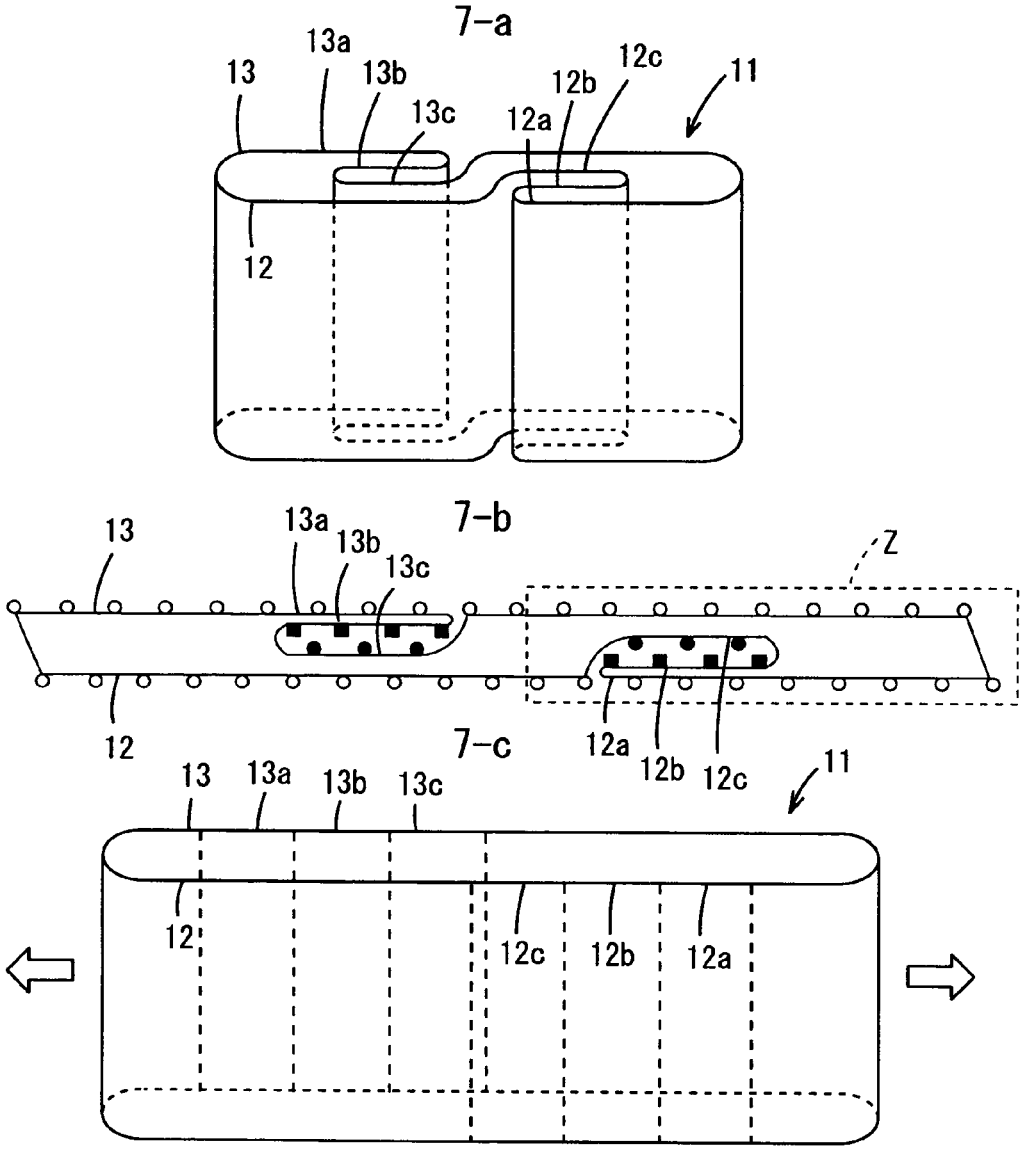
FIG. 7-*a* is a view showing a knitted state of a tubular knitted fabric 11 of the second embodiment.
Figure 8:
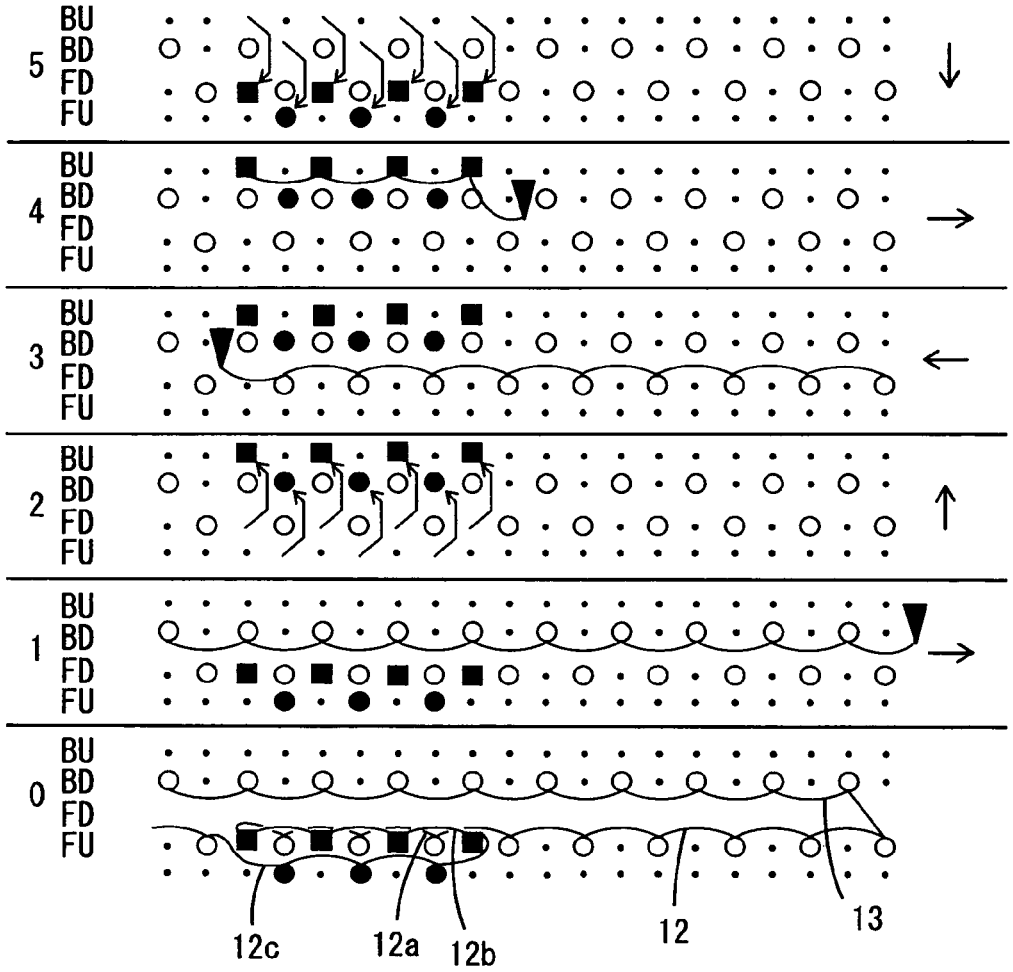
FIG. 8 is a knitting course diagram illustrating the second embodiment.
Figure 9:
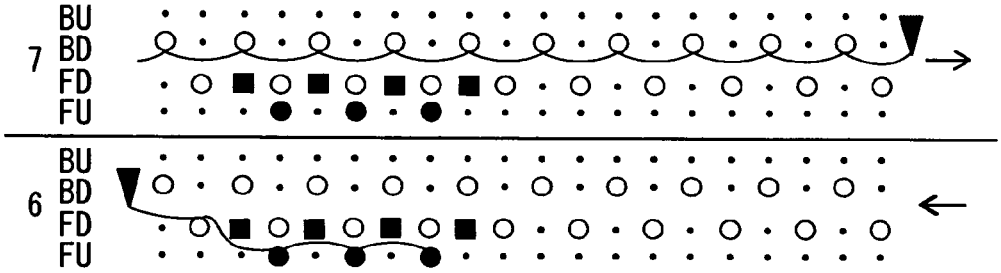
FIG. 9 is a knitting course diagram illustrating the second embodiment.

Sequentially, the second embodiment of the invention will be described with reference to FIGS. 7 to 9. The second embodiment as illustrated is directed to a knitting method wherein the folded-in-three-layer regions of the knitted fabric can be developed in such a relation as to be arranged in series in the widthwise direction of the knitted fabric on completion of the knitting. FIG. 7-*a* is a view showing a knitted state of a tubular knitted fabric 11 of the second embodiment knitted on the flat knitting machine. FIG. 7-*b* is a diagram showing the loop position of the tubular knitted fabric 11 of FIG. 7-*a*. FIG. 7-*c* is a view showing a developed state of the knitted fabric of FIG. 7-*a* after completion of the knitting. FIGS. 8–9 are knitting course diagrams illustrating the second embodiment. The tubular knitted fabric 11 is knitted with its front knitted fabric 12 and back knitted fabric 13 overlapped one above the other and continuously connected to each other at both ends thereof. Each of the front knitted fabric 12 and the back knitted fabric 13 comprises a region where a front-layer knitted fabric portion 12*a*, 13*a*, a middle-layer knitted fabric portion 12*b*, 13*b* and a back-layer knitted fabric 12*c*, 13*c* are knitted to be folded over in three layers, and the remaining single layer portion. In the following, explanation is given with reference to the drawings. As the knitted fabric portions are knitted with left-right and front-back symmetry, only the knitting of the part of the knitted fabric surrounded by a dotted line Z in FIG. 7-*b* is described. In the second embodiment, the same four-bed flat knitting machine as the knitting machine used in the first embodiment is used. The course 0 of FIG. 8 indicates the loop position. Loops of the front-layer knitted fabric portion 12*a* of the front knitted fabric 12 to be folded over in three layers are held by the odd-numbered needles from the left end of the lower front needle bed. Loops of the back-layer knitted fabric portion 12*c* are held by the even-numbered needles from the left end of the upper back needle bed, and loops of the middle-layer knitted fabric portion 12*b* are held by the odd-numbered needles from the left end of the lower front needle bed. In the course 1, the back body 13 is knitted with alternate needles of the lower back needle bed in the state in which the front-layer knitted fabric portion 12*a*, the middle-layer knitted fabric portion 12*b* and the back-layer knitted fabric portion 12*c* are attached to the front needle bed. In the course 2, before the knitting of the front-layer knitted fabric portion 12*a* of the front knitted fabric 12, the back-layer knitted fabric portion 12*c* is transferred to the needles of the lower back needle bed and the middle-layer knitted fabric portion 12*b* is transferred to the upper back needle bed. In the course 3, the front-layer knitted fabric portion 12*a* of the front knitted fabric 12 is knitted with alternate needles on the front needle bed in the state in which the middle-layer knitted fabric portion 12*b*, the back-layer knitted fabric portion 12*c* and the back knitted fabric 13 are attached to the back needle bed. In the course 4, the yarn feeding direction is reversed and the middle-layer knitted fabric portion 12*b* on the upper back needle bed is formed. In the course 5, the middle-layer knitted fabric portion 12*b* is transferred to the lower front needle bed, and the back-layer knitted fabric portion 12*c* is transferred to the upper front bed. In the course 6 of FIG. 9, the back-layer knitted fabric portion 12*c* and the front knitted fabric 12 located at the left side of a center line are knitted in the state in which the front-layer knitted fabric portion 12*a* and the middle-layer knitted fabric portion 12*b* are attached to the front needle bed and the back body 13 is attached to the back needle bed. Subsequently, the right side of the tubular knitted fabric, not shown, is knitted. Then, in the course 7, the back knitted fabric 13 is knitted rightwards in the state in which the front-layer knitted fabric portion 12*a*, the middle-layer knitted fabric portion 12*b*, and the back-layer knitted fabric portion 12*c* of the front knitted fabric 12 are attached to the front needle bed. Subsequently, the knitting of the knitting courses 2–7 is repeatedly performed. The tubular knitted fabric 11 shown in FIG. 7 is knitted in this manner. The tubular knitted fabric 11 knitted in the knitting mentioned above is transformed into the knitted fabric shown in FIG. 7-*c* by developing the folded portions. The method of this embodiment can permit knitting of the tubular knitted fabric of a larger diameter using the needle bed having the common width, as compared with the method of knitting the tubular knitted fabric in the state in which its portions to be folded over in three layers are developed in the widthwise direction of the needle bed.

Third Embodiment

Figure 10:
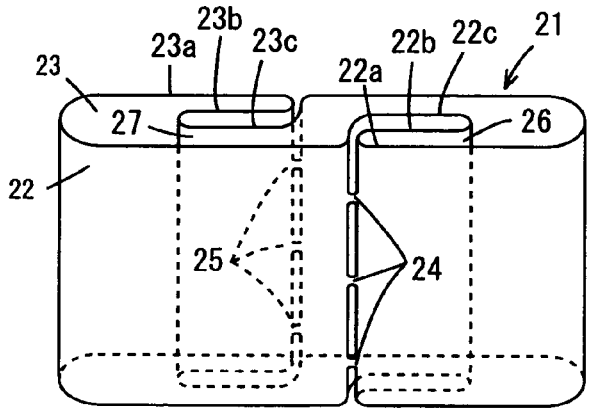
FIG. 10 shows a tubular knitted fabric 21 of the third embodiment.
Figure 11:
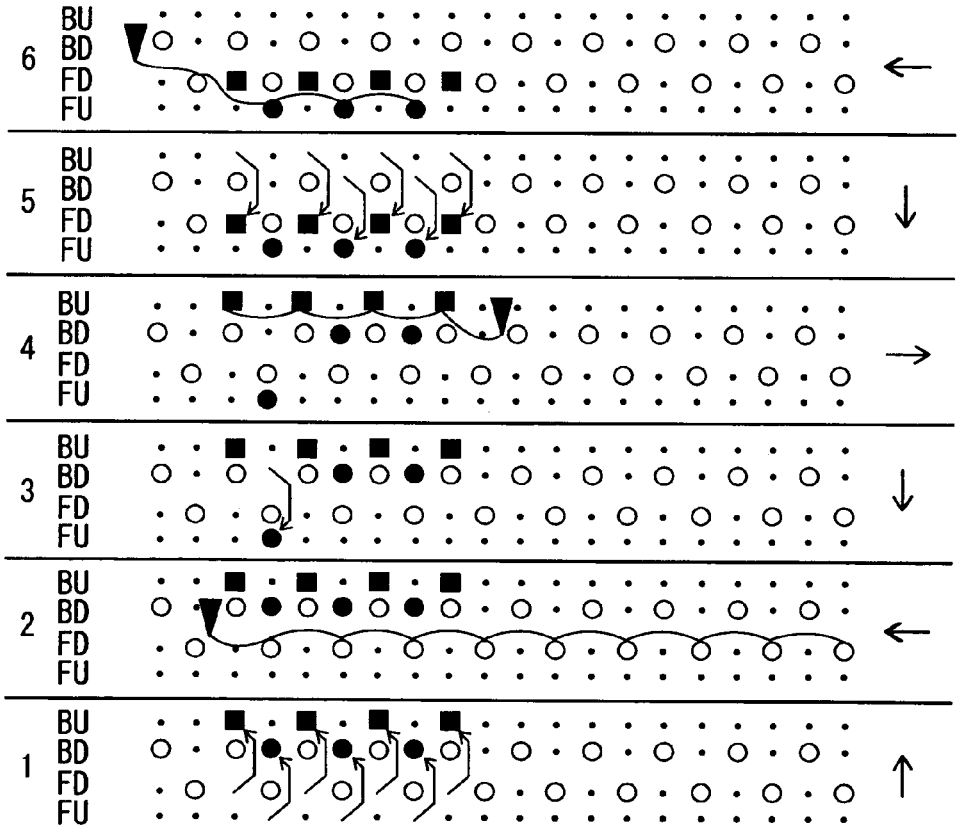
FIG. 11 is a knitting course diagram illustrating the third embodiment.

Sequentially, the second embodiment of the invention will be described with reference to FIGS. 10–11. FIG. 10 shows a tubular knitted fabric 21 knitted in the third embodiment. FIG. 11 is a knitting course diagram illustrating the third embodiment. The tubular knitted fabric 21 knitted in the third embodiment is an embodied example knitted by a method of knitting a knitting pattern, which is called a pinch pattern, wherein a knitting course to connect a boundary portion between the front-layer knitted fabric portion 22*a*, 23*a* and the middle-layer knitted fabric portion 22*b*, 23*b* with the back-layer knitted fabric portion 22*c*, 23*c* is formed in a region where a front-layer knitted fabric portion 22*a*, 23*a*, a middle-layer knitted fabric portion 22*b*, 23*b*, a back-layer knitted fabric portion 22*c*, 23*c* of a front knitted fabric 22 and back knitted fabric 23 are knitted to be folded back. In the following, explanation is given with reference to the knitting course diagram. In the third embodiment, the region where the front-layer knitted fabric portion 22*a*, 23*a* and the back-layer knitted fabric portion 22*c*, 23*c* are separate from each other is knitted in the same knitting as in the second embodiment. On the other hand, when the region where the boundary portion between the front-layer knitted fabric portion 22*a*, 23*a* and the middle-layer knitted fabric portion 22*b*, 23*b* is linked with the back-layer knitted fabric portion 22*c*, 23*c* through bridging portions 24, 25 is knitted, the following knitting is performed. In the third embodiment as well, only the knitting of the part of the knitted fabric surrounded by a dotted line Z in FIG. 7-*b* is described, for the same reason as in the second embodiment.

Following the knitting of the second embodiment, the knitting of the courses 1–6 of FIG. 11 is performed. In the course 1, before the knitting of the front-layer knitted fabric portion 12*a*, the middle-layer knitted fabric 22*b* and the back-layer knitted fabric portion 22*c* are transferred onto the back needle bed. In the course 2, the yarn is fed to the front knitted fabric 22 and the front-layer knitted fabric portion 22*a* in the folded-in-three-layer region from right to left in the state in which the middle-layer knitted fabric portion 22*b*, the back-layer knitted fabric portion 22*c* and the back knitted fabric 23 are attached to the back needle bed, to form loops therein 22, 22*a*. In the course 3, the loops at the boundary portion between the middle-layer knitted fabric portion 22*b* and the back-layer knitted fabric portion 22*c* are transferred to the needles of the upper front needle bed. In the course 4, the middle-layer knitted fabric portion 22*b* held on the upper back needle bed is knitted from left to right. In the course 5, the loops of the middle-layer knitted fabric portion 22*b* and the back-layer knitted fabric portion 22*c* held by the needles on the back needle bed are transferred to the lower front needle bed and the upper front needle bed. In the course 6, the yarn is fed to the back-layer knitted fabric portion 22*b* held on the upper front needle bed from right to left in the state in which the front-layer knitted fabric portion 22*a* and the middle-layer knitted fabric portion 22*b* are attached to the front needle bed and the back knitted fabric 23 is attached to the back needle bed, to knit the left side of the tubular knitted fabric 21 not shown. Whenever the knitting of the second embodiment is repeated in a proper number of times, the knitting of the third embodiment is performed. This knitting is repeatedly performed to knit the tubular knitted fabric 21 shown in FIG. 10. In the knitted fabric knitted in accordance with the third embodiment, the boundary portion between the front-layer knitted fabric portion 22*a*, 23*a* and the middle-layer knitted fabric portion 22*b*, 23*b* is linked with the back-layer knitted fabric portion 22*c*, 23*c* via the bridging portions 24, 25 bridging therebetween, so that tubes 26, 27 are formed. Although the boundary portion between the front-layer knitted fabric portion 22*a*, 23*a* and the middle-layer knitted fabric portion 22*b*, 23*b* is linked with the back-layer knitted fabric portion 22*c*, 23*c* by the stitch transference in the third embodiment mentioned above, those 22*a*, 23*a*, 22*b*, 23*b* may be linked therewith via jacquard feeding the yarn continuously.

Although the knitted fabric is folded over in three layers at only one location in each of the front knitted fabric and the back knitted fabric in the embodiments illustrated above, the knitted fabric may be folded over in three layers at two or more locations in each of the front knitted fabric and the back knitted fabric. In the latter case, the folded-over portions should be arranged not to be overlapped with each other in the knitting width direction. Although the tubes are formed at the inside of the tubular knitted fabric in the third embodiment mentioned above, the tubes may be formed at the outside of the tubular knitted fabric. If the boundary portion between the front-layer knitted fabric portion 22*a* and the middle-layer knitted fabric portion 22*b* is linked with the back-layer knitted fabric portion 22*c* in every course, then a completely closed tube will be defined by the middle-layer knitted fabric portion 22*b* and the back-layer knitted fabric portion 22*c*. Although the explanation has been started from the state in which the front-layer knitted fabric portion, the milled-layer knitted fabric portion and the back-layer knitted fabric portion are folded over in three layers in the embodiments mentioned above, those portions may be folded back in three layers in the set-up knitting or may be folded over in three layers in the knitting process. Also, although the knitted fabric having a single jersey structure has been described in the embodiments above, the knitted fabric having a rinks structure in which front stitches and back stitches are mixed will do. In the latter case, for example, the loops to be formed as the front stitch in the front-layer knitted fabric portion of the front knitted fabric are formed as the front stitch on the front needle bed, whereas the loops to be formed as the front stitch in the middle-layer knitted fabric portion are formed as the back stitch on the back needle bed. On the other hand, the loops to be formed as the back stitch in the front-layer knitted fabric portion are formed as the back stitch on the back needle bed, whereas the loops to be formed as the back stitch in the middle-layer knitted fabric portion are formed as the front stitch on the front needle bed. The loop arrangement in the middle-layer knitted fabric portion is formed with bilateral symmetry with the loop arrangement formed in the corresponding knitted fabric portion without being folded back in three layers. In the embodiments illustrated above, the front knitted fabric and the back knitted fabric are both folded back so that the front bodies can be equal in circumferential length to the back body. Alternatively, only either of the front bodies and the back body can be folded back. In the ratter case, a knitted fabric whose front body and back body are made different in circumferential length from each other can be knitted intentionally. Although the front knitted fabric and the back knitted fabric are folded back in the same knitting width in the embodiments illustrated above, they may alternatively be made different in folding width from each other.

INDUSTRIAL APPLICABILITY

As seen from the foregoing, according to the present invention, since at least a part of the knitted fabric is folded back in three layers and combined in four layers in the knitting, a tubular knitted fabric having a larger diameter can be knitted without any need to widen the width of the needle bed used for the knitting. Also, for example when a sweater or a cardigan is knitted by joining together the tubular body and the sleeves knitted at both lateral sides of the body, the knitted fabric is folded back in three layers at the region thereof, except the regions where change in knitting width caused by forming a neckline opening in the body in the course forming direction or by joining the body to the sleeves exerts a significant influence on the pattern design. This can allow the change of size to adjust the diameter of the tubular body with ease by simply altering the width of the folded-in-three-layer region.

What is claimed is:

1. A method of knitting a tubular knitted fabric, whose first knitted fabric and second knitted fabric are continuously connected with each other at both ends thereof, using a flat knitting machine comprising at least a pair of first and second needle beds arranged in front and back, either of or both of which are slidably moved in a transverse direction, wherein three sectioned portions of a front-layer knitted fabric portion (3*a*, 12*a*), a middle-layer knitted fabric portion (5*b*, 12*b*) and a back-layer knitted fabric portion (5*a*, 12*c*), into which a part of the first knitted fabric is sectioned in a widthwise direction of the knitted fabric, are folded back in three layers at their respective boundaries so that the front-layer knitted fabric portion (3*a*, 12*a*), the middle-layer knitted fabric portion (5*b*, 12*b*) and the back-layer knitted fabric portion (5*a*, 12*c*) can be formed sequentially from a front side of the knitted fabric, whereby after completion of the knitting of the knitted fabric, the back-layer knitted fabric portion (5*a*, 12*c*) in that folded region or both of the back-layer knitted fabric portion (5*a*, 12*c*) and the middle-layer knitted fabric portion (5*b*, 12*b*) can be developed in a widthwise direction of the knitted fabric, the method comprising:

(a) the step of forming the front-layer knitted fabric portion (3*a*, 12*a*) in the state in which the middle-layer knitted fabric portion (5*b*, 12*b*) and the back-layer knitted fabric portion (5*a*, 12*c*) and the second knitted fabric are attached to needles on the second needle bed, (b) the step of forming the middle-layer knitted fabric portion (5*b*, 12*b*) of the first knitted fabric in the state in which the front-layer knitted fabric portion (3*a*, 12*a*) is attached to needles on the first needle bed and also the back-layer knitted fabric portion (5*a*, 12*c*) and the second knitted fabric are attached to the needles on the second needle bed, (c) the step of forming the back-layer knitted fabric portion (5*a*, 12*c*) in the state in which the front-layer knitted fabric portion (3*a*, 12*a*) and the middle-layer knitted fabric portion (5*b*, 12*b*) are attached to the needles on the first needle bed and also the second knitted fabric is attached to the needles on the second needle bed, and (d) the step of forming the second knitted fabric in the state in which the front-layer knitted fabric portion (3*a*, 12*a*), the middle-layer knitted fabric portion (5*b*, 12*b*), and the back-layer knitted fabric portion (5*a*, 12*c*) are attached to the needles on the first needle bed.

2. The method of knitting the tubular knitted fabric according to claim 1, wherein loops that result in a front stitch on completion of the knitting are formed as a back stitch in the middle-layer knitted fabric portion (5*b*, 12*b*), and loops that result in a back stitch on completion of the knitting are formed as the front stitch in the middle-layer knitted fabric portion.

3. The method of knitting the tubular knitted fabric according to claim 1, wherein the middle-layer knitted fabric portion (5*b*, 12*b*) is formed with the needles on the second needle bed.

4. The method of knitting the tubular knitted fabric according to claim 1, wherein a folded-in-three-layer region, which is substantially identical with the folded region formed in the first knitted fabric and is formed into the front-layer knitted fabric portion (13*a*), the middle-layer knitted fabric portion (13*b*), and the back-layer knitted fabric portion (13*c*) sequentially from the front side of the knitted fabric, is also formed in the second knitted fabric in a region thereof different from the folded region in the first knitted fabric with respect to a longitudinal direction of the needle bed.

* * * * *